US005431406A

United States Patent [19]

Ishii

[11] Patent Number: 5,431,406

[45] Date of Patent: Jul. 11, 1995

[54] APPARATUS FOR FIXING INCLINED POSITION OF STAND PLATES AND THE LIKE

[76] Inventor: Takaaki Ishii, 1978-1, Oaza, Misato-cho, Kadama-gun, Saitama-ken, Japan

[21] Appl. No.: 195,140

[22] Filed: Feb. 14, 1994

[30] Foreign Application Priority Data

Mar. 22, 1993 [JP] Japan ..... 5-018879 U

[51] Int. Cl.[6] ..... A63B 69/36

[52] U.S. Cl. ..... 273/195 B

[58] Field of Search ..... 273/195 B, 449; 434/242, 247, 258, 55, 58

[56] References Cited

U.S. PATENT DOCUMENTS

| | | | |
|---|---|---|---|
| 3,633,918 | 1/1972 | Smiley | 273/195 B |
| 4,875,684 | 10/1989 | Benilan | 273/195 B |
| 5,133,557 | 7/1992 | Sugimoto | 273/195 B X |
| 5,263,863 | 11/1993 | Stefani et al. | 273/195 B X |

*Primary Examiner*—William H. Grieb

*Attorney, Agent, or Firm*—Lowe, Price, LeBlanc & Becker

[57] ABSTRACT

Disclosed is an apparatus for fixing inclined position of stand plates and the like, in which making a stand plate and the like possible to incline in an optional angle in all directions of 360° and the fixing of an inclined position is made easy and tight. A movable plate 8 is interposed and inserted in a gap 9 provided between an upper plate 4 and a lower plate 5 of a stand frame 2. The center of a stand plate 16 is supported by a spherical joint 17 in tilting movement free on a main column 14 provided in standing state on the stand frame 2. A plurality of spiral shafts 19 hanged down from the back face of the stand plate 16 in conical rotation free are thrust into the stand plate 2 and penetrated through rubber bushes 13 fitted to the movable plate 8. A moving and fixing mechanism 22 for the movable plate 8 is provided at one side of the stand frame 2, with which one end of the movable plate 8 is engaged. The stand plate 16 is placed in an optional inclined angle in a desired direction, thereafter the moving and fixing mechanism 22 is used to move the movable plate 8 in a direction perpendicular to the spiral shafts 19, the rubber bushes 13 are pushed and pressed against the spiral shafts 19, and the above-mentioned stand plate 16 is fixed at the inclined position by having the same shafts 19 cut and engaged into the rubber bushes 13.

1 Claim, 3 Drawing Sheets

APPARATUS FOR FIXING INCLINED POSITION OF STAND PLATES AND THE LIKE

FIELD OF THE INVENTION

The present invention relates to an apparatus for fixing an inclined position of stand plates and the like which are freely capable of tilting movement, such as a golf training stand and the like.

DESCRIPTION OF THE RELATED ARTS

For example, in golf courses, there is hardly a case in which the ground where a ball is shot is flat, and most parts of a golf course are on inclined grounds.

Therefore, in a golf training field, it is effective for facilitating progress in the skill of playing golf to train for golf shots under a condition equivalent to landforms in golf courses.

Conventionally, there have been known training stand apparatuses for inclined ground shots for making inclined planes corresponding to landforms of positions where a ball is shot in a golf course, for example, such as inclined grounds rising frontward, descending frontward, rising rightward, descending rightward, rising leftward and descending leftward.

As for the above-mentioned training stand apparatuses, there are those of an electrically-driven type, a hydraulic type and a manual non-motive power type.

In the electrically-driven type, for example, a stand plate on which a golf player stands is freely supported in tilting movement by a spherical joint at its central position which is its center of gravity, end portions of one wire are fixed to diagonal points of the back side of the stand plate respectively, the wire is wound at its intermediate position around a pulley of a motor, and an inclined angle is adjusted by pulling in it by electric power. This mechanism is realized by the wires and the motors of the two axes of ordinate and abscissa (so-called X-Y), so that tilting movement is free over 360° directions (trade name: "AXIS").

In the hydraulic type, a mechanism like a spherical joint is provided at the back side of a stand plate on which a golf player stands, and the player tilts this stand plate in a desired angle by his or her body weight and the like. At this time, by having an inner sphere constituting the spherical joint contact by pressure with the inner surface of a spherical shell which is its housing using a hydraulic cylinder, the stand plate is fixed due to its friction force (Japanese Patent Application Laid-Open No. 238888-1988).

As for the manual type, one known device is provided with legs which are capable of folding at four corners of a rectangular plate.

However, because the first type is driven electrically, there is concern that the foot of the player would be caught between the tilting stand plate and frame stand and resulting in a serious injury. (A written caution of that effect is attached to the above-mentioned commercial product too.) In addition, there is also an accident of a type wherein a golf ball which rolls down from the inclined stand plate is caught in the same manner. Further, it is also supposed that the wire elongates due to use for a long period, and looseness occurs in the stand plate. In addition, also due to the fact that electric control is required for each of the two axes, the apparatus becomes complicated and expensive.

On the other hand, the second type has no risk to catch the player because the angle adjustment itself does not use motive power, however, the body weight and the like of the player must be supported by the friction force at the central one point, so that a hydraulic mechanism (motor, pump, tank, various valve mechanisms, piping, wiring and the like) becomes essential. Therefore, this device becomes complicated and expensive in the same manner as the first one.

It is needless to said that either of the above-mentioned two types of devices cannot be used at places where there is no electric power source. However, the third type has advantages in that it suffers no limitation of the place for use because no electric power source is required, and it is structurally simple. However, on the contrary, this type has a drawback in that the inclined angle is constant depending on the length of legs, and only four kinds of inclined planes (other than the horizontal plane) are made.

SUMMARY OF THE INVENTION

The present invention has been made taking such problems of the above-mentioned prior art into consideration, and an object of the invention is to provide an apparatus for fixing inclined position of stand plates and the like which has made it possible to incline and fix a stand plate at an optional angle in any direction covering 360°, with a simple constitution.

In order to achieve the above-mentioned object, an apparatus for fixing an inclined position of stand plates and the like according to the present invention is characterized in that:

it comprises a stand frame in which a movable plate is interposed and inserted in a gap formed between an upper plate and a lower plate by lying spacers; a stand plate in which its center is supported in tilting movement free on an upper end of a main column set up on said stand frame and a plurality of spiral shafts are provided vertically downwardly in conical rotating movement free at its back face; and a moving and fixing mechanism for the movable plate supported pivotally rotatably at one side of said stand frame, said movable plate is reciprocal movement free due to the rotation, and engaged and supported in fixing free; and each of said spiral shafts is inserted into insertion holes formed by boring through both the upper and lower plates of said stand frame and the movable plate in sliding movement free to their axial directions so that spiral thread grooves at their outer circumferences cut into inner faces of the insertion holes to be fastened accompanying with the movement of the movable plate.

When the stand plate is pushed down downwardly to a desired position by manual operation, the stand plate can tilt to desired directions owing to the fact that its center is supported on the upper end of the main column by means of a spherical joint.

When the stand plate is adjusted to have a desired inclined angle in a desired direction, among the plurality of the spiral shafts, the spiral shafts at a side where the stand plate has descended are pushed down, while the spiral shafts at an opposite side where the stand plate has risen are raised upwardly.

Therefore, in the above-mentioned state, the movable plate is moved to a predetermined direction by performing a rotating operation of the moving and fixing mechanism for the movable plate to a predetermined direction, so that rubber bushes fitted thereto are strongly pushed and pressed against the spiral thread grooves threaded on the outer circumference of each of the spiral shafts and cut into them.

Thereby, each of the spiral shafts is fastened and fixed to the stand frame, so that the stand plate is held at the adjusted inclined angle.

In addition, when the stand plate is placed at a horizontal position or inclined to a direction which is different from the above-mentioned inclining and descending direction, by rotating the moving and fixing mechanism for the above-mentioned movable plate to a direction opposite to the above-mentioned direction, the movable plate is relieved of its fixation and simultaneously restored to the original position, the cut-in of the rubber bushes into the spiral thread grooves of the spiral shafts is released, and the fastening and fixing of each of the spiral shafts is canceled. Therefore, when the stand plate is manually operated after being in such a state, the stand plate can be positioned horizontally or at an incline and can descend to a direction which is different from the above-mentioned direction.

Also, in this case, the fixing of the inclined position of the stand plate can perform in the same manner as described above.

DESCRIPTION OF THE PREFERRED EMBODIMENTS

The present invention will be explained hereinafter with reference to the drawings with respect to one embodiment illustrating a golf training stand apparatus.

Figure 1:
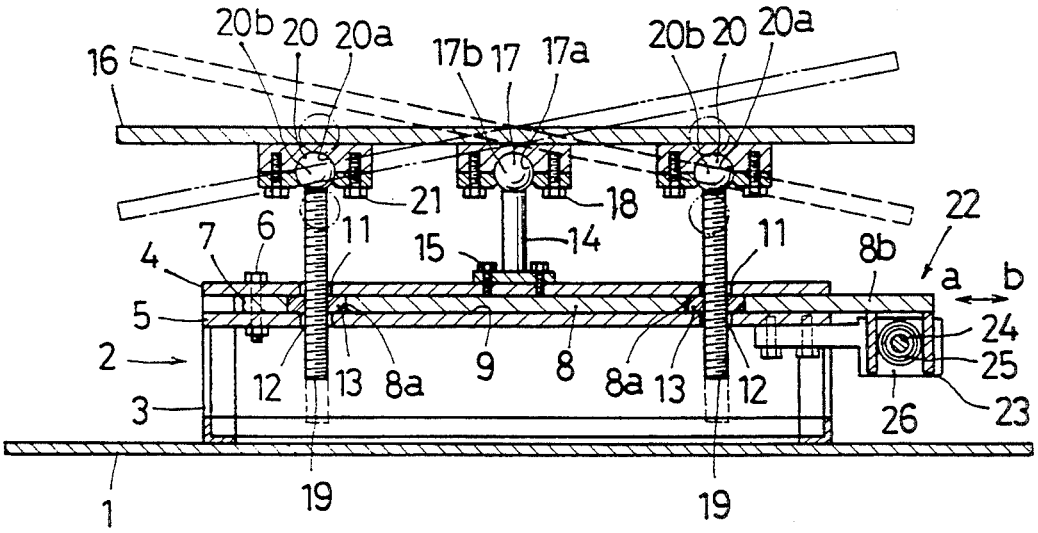
FIG. 1 is a vertical sectional view showing the first embodiment of the apparatus for fixing an inclined position of stand plates and the like according to the present invention.
Figure 2:
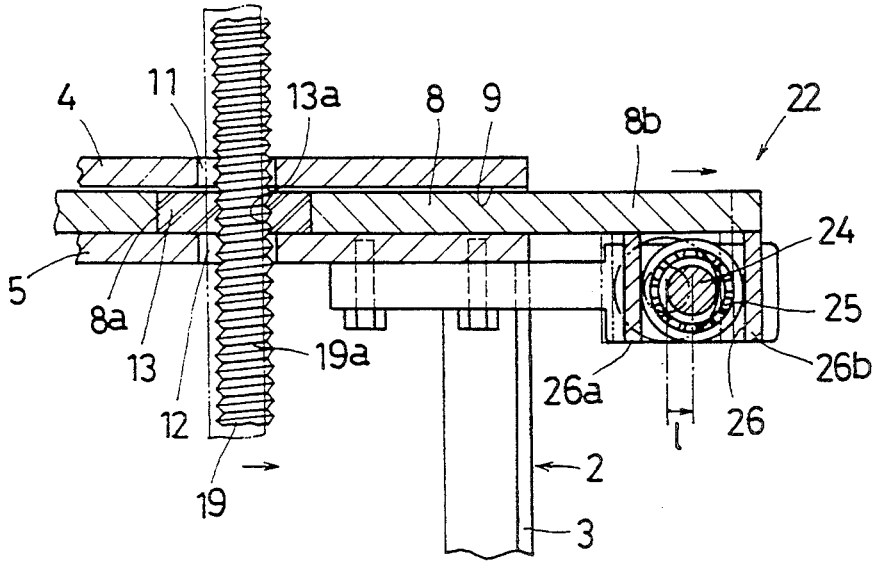
FIG. 2 is a partially enlarged vertical sectional view showing the same embodiment.
Figure 3:
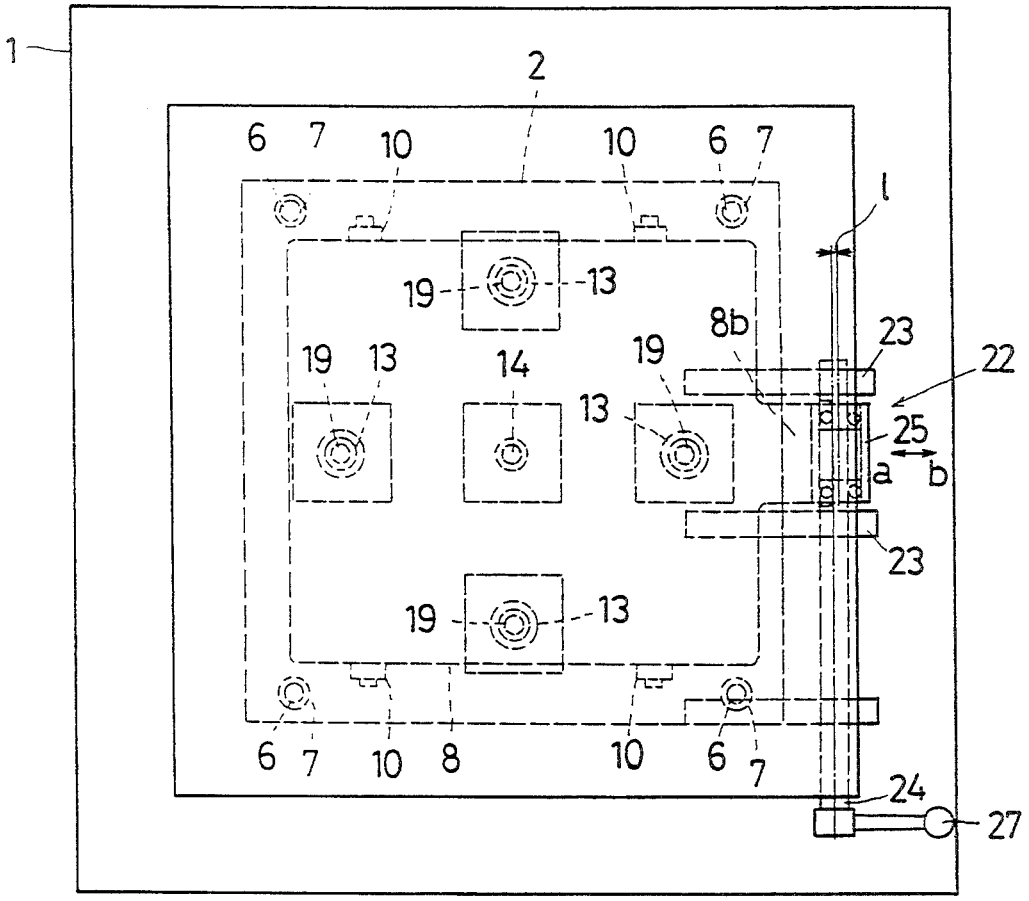
FIG. 3 is a plan view showing the same embodiment.

FIG. 1 shows a vertical sectional view of the first embodiment, FIG. 2 shows a partially enlarged sectional view of the same embodiment, and FIG. 3 shows a plan view of the same embodiment.

As shown in FIG. 1 to FIG. 3, a stand frame 2 is fixed at a central portion of an upper face of a base plate 1.

The above-mentioned stand frame 2 is formed as a plane rectangular shape by horizontally fixing an upper plate 4 and a lower plate 5 to an upper end of a frame body 3 fixed to the upper face of the base plate 1.

The above-mentioned upper plate 4 and the lower plate 5 are integrally fixed at a constant space in a vertical direction with a plurality of spacers 7 fastened by a plurality of bolts 6 between the plates 4, 5, thereby forming a gap 9 for inserting a movable plate 8 between the upper and lower plates 4, 5.

As shown in FIG. 3, the above-mentioned movable plate 8 is formed as a plane rectangular shape, which is interposed and inserted in the above-mentioned gap 9 in reciprocal movement free in right and left directions in the figure by pivotally supporting plural guide rollers 10 at both frontward and rearward side ends.

In addition, at the front and rear and the right and left of both the upper and lower plates 4, 5 of the above-mentioned stand frame 2, four each of insertion holes 11, 12, in which spiral shafts (which will be described hereinafter) are inserted in the axial direction freely and movably, are formed by being penetrated opposingly and vertically.

On the other hand, at positions of the above-mentioned movable plate 8 coinciding with each of the above-mentioned insertion holes 11, 12, holes **8*a* having a large diameter are formed penetratingly in the vertical direction, and to each of the holes 8*a* are fitted rubber bushes 13 formed by penetrating in the vertical direction, the penetrating holes 13*a* shown in FIG. 2**, for allowing the spiral shafts which will be described hereinafter to be pushed and inserted at the center.

At the center of the upper face of the above-mentioned stand frame 2, a main column 14 is fastened in standing state with bolts 15, and on the upper end of the main column 14, the center of the back face of the stand plate 16 is secured by means of a spherical joint 17 to provide free tilting movement over full circumferential directions of 360°.

As clearly shown in FIG. 1, the above-mentioned spherical joint 17 is formed to a fixed spherical seat **17*a* by fastening with bolts 18 at the back face of the stand plate 16 by fitting a rotatably formed spherical journal 17*b* at the upper end of the main column 14**.

At positions coinciding with each of the insertion holes 11, 12 of the above-mentioned stand frame 2 in the back face of the above-mentioned stand plate 16, the four spiral shafts 19 are vertically provided in the downward direction by supporting their upper ends with spherical joints 20 so they are rotatable in conical shapes.

As clearly shown in FIG. 2, spiral thread grooves **19*a* are threaded at the outer circumferential face of each of the above-mentioned spiral shafts 19, and the spiral thread grooves 19*a* are formed such that the above-mentioned rubber bushes 13** cut into them by pressing.

In the same manner as the above-mentioned spherical joint 17, the above-mentioned spherical joint 20 is formed to a spherical seat **20*a* fastened with bolts 21 to the back face of the stand plate 16 by fitting a spherical journal 20*b* formed at an upper end of the above-mentioned spiral shaft 19** rotatably.

Moreover, each of the above-mentioned spiral shafts 19 is penetrated through the insertion holes 11, 12 of the above-mentioned stand frame 2 and the penetrating holes **13*a* of the rubber bushes 13** movable in the axial direction (vertical direction).

The moving and fixing mechanism 22 for the above-mentioned movable plate 8 is constituted as follows.

An eccentric shaft 24 is provided rotatably to hang on brackets 23, 23 provided protrudingly in parallel at one side of the above-mentioned stand frame 2, and a bearing 25 is installed and fixed to the eccentric shaft 24 in a package.

On the other hand, at the back face of the protruding portion **8*b* provided at one side of the above-mentioned movable plate 8, a downwardly directing guide groove 26 is formed by means of two guide plates 26*a*, 26*b* fixed by being hanged down in parallel from the back face of the above-mentioned protruding portion 8*b*. The moving and fixing mechanism 22 is constituted by fitting the above-mentioned bearing 25 to the above-mentioned guide groove 26**.

With respect to the above-mentioned moving and fixing mechanism 22, by rotating the eccentric shaft 24, the bearing 25 moves by its eccentric distance 1 in the left direction or the right direction in the figure, and the movable plate 8 having the guide groove 26 to which the bearing is fitted, is moved in a direction of arrow (a) or a direction of arrow (b) shown in FIG. 1 and FIG. 3, thereby the above-mentioned rubber bushes 13 are pushed and pressed against the spiral shafts 19 in a direction perpendicular to the axial direction, which cut into the spiral thread grooves 19*a*, resulting in fastening and fixing of the spiral shafts 19 in the axial direction.

In addition, instead of the above-mentioned bearing 25, it is possible to use a disk-shaped cam (not shown).

Further, as a means for rotating the above-mentioned eccentric shaft 24, it is also possible to use a motor other than a handle 27 shown in the figure.

Figure 4:
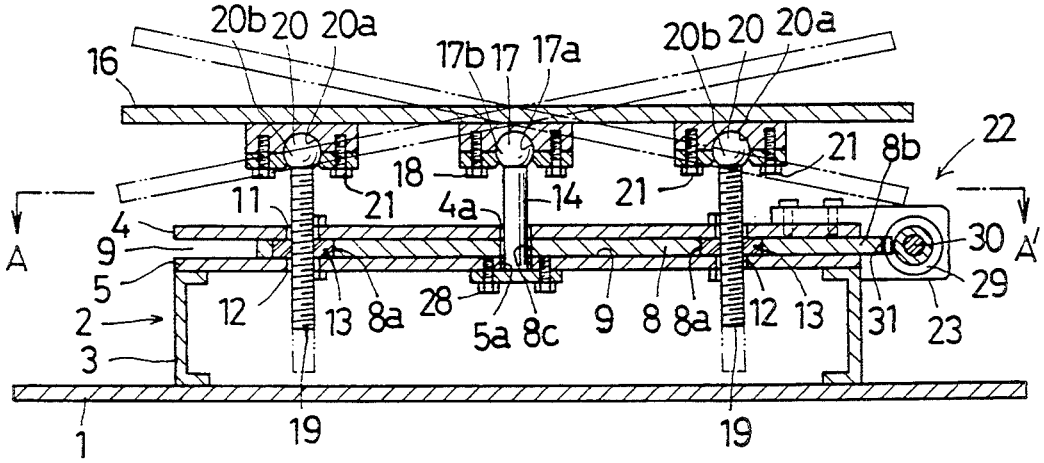
FIG. 4 is a vertical sectional view showing the second embodiment of the apparatus for fixing an inclined position of stand plates and the like according to the present invention.
Figure 5:
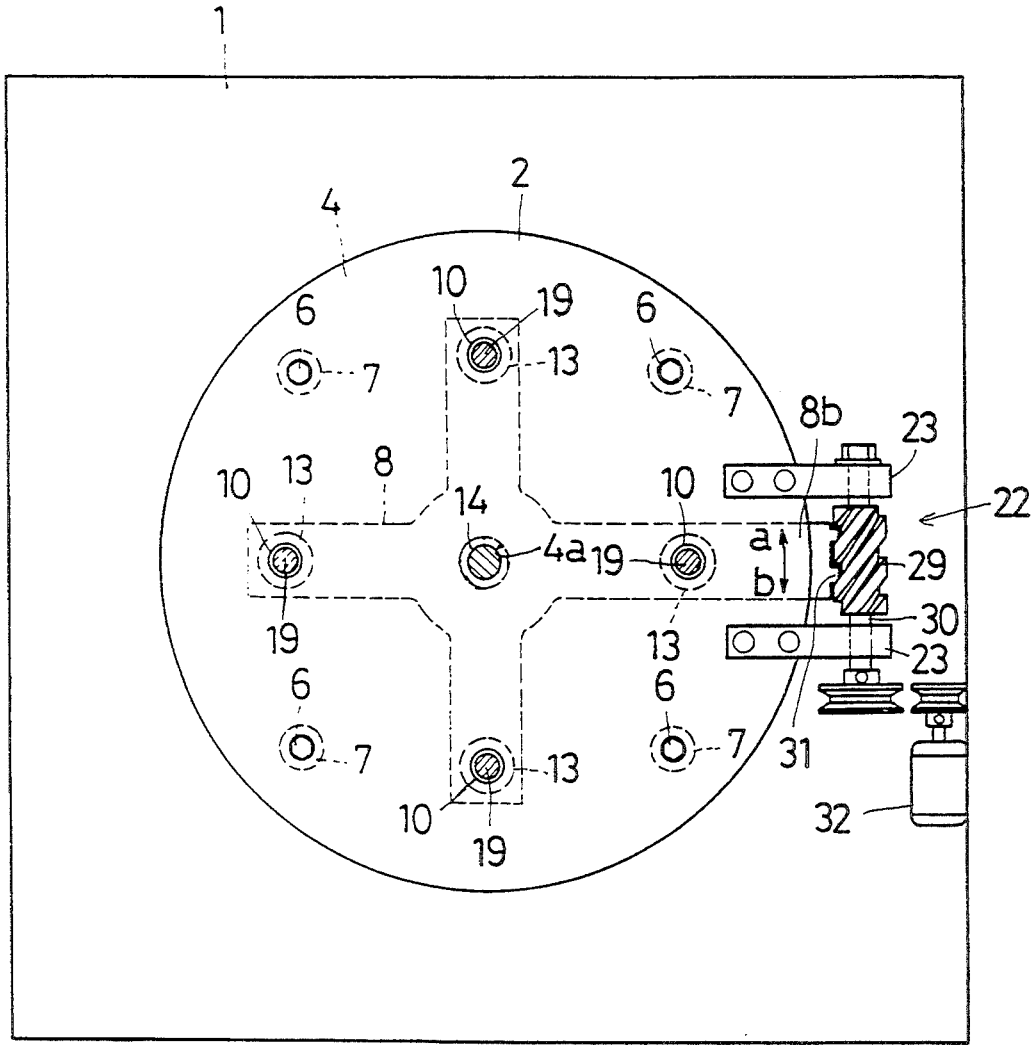
FIG. 5 is a sectional view as viewed in the section A—A' in FIG. 4 in the arrow direction.

FIG. 4 shows a vertical sectional view of the second embodiment of the present invention, and FIG. 5 shows a sectional view as viewed in the section A—A′ in FIG. 4 in the direction of the arrows.

As shown in FIG. 4 and FIG. 5, in a gap 9 between both upper and lower plates 4, 5 of a stand frame 2 made as a plane circular shape, there is interposed and inserted a movable plate 8 made as a plane with approximately a cross shape, into shaft holes 4*a*, 5*a*, 8*c* penetratingly formed in an upward direction coinciding with centers of the above-mentioned upper and lower plates 4, 5. In the movable plate 8 there is inserted the above-mentioned main column 14 from the lower part of them to fix it to the lower plate 5 by fastening with bolts 28, and have the main column 14 stand upwardly. The above-mentioned movable plate 8 is made to reciprocate (rotate) in the circumferential direction using the main column 14 as the center.

In addition, the above-mentioned rubber bushes 13 are fitted respectively to the vicinities of the end portions of four plate portions making the cross shape of the movable plate 8, and a protruding portion 8*b* extending to the outside is formed at one plate portion.

A moving and fixing mechanism 22 for the movable plate 8 in this second embodiment is constituted as follows.

The structure is made such that a worm 29 is rotatably supported by a worm shaft 30 on brackets 23, 23 provided protrudingly at one side of the above-mentioned stand frame 2, while the forward end of the protruding portion 8*b* of the above-mentioned movable plate 8 is formed into a worm wheel 31, and the worm wheel 31 is meshed with the above-mentioned worm 29.

By being rotated, the worm 29 by the above-mentioned worm shaft 30, the protruding portion 8*b* formed at the work wheel 31 is rotated in a direction of arrow (a) or a direction of arrow (b) sown in FIG. 5, thereby the rubber bushes 13 are pushed and pressed in a direction perpendicular to the axial direction of the spiral shafts 19, so that the spiral shafts 19 are fastened and fixed.

In the drawings, there is shown the case in which the above-mentioned worm shaft 30 is rotated by a motor 32. However, it is also possible to rotate manually using a handle.

Other aspects of the second embodiment are constituted in the same manner as the case according to the above-mentioned first embodiment and thus are not further described.

Incidentally, the apparatus of the present invention is not limited to the golf training stand apparatus shown in the figures, which can be adopted to all of those applications in devices which require the inclination adjustment of a stand plate and the like in a desired direction and fix it at the inclined position.

The present invention is constituted as explained above, so that besides being adjustable in an optional inclined angle in all directions of 360°, the stand plate can be easily fixed at the inclined angle.

Further, the rubber bushes are pushed and pressed by the movable plate against the spiral shafts in the direction perpendicular to the axial direction. Thereby the rubber bushes are cut into the spiral thread grooves of the spiral shafts, so that besides obtaining a large friction force, the movable plate is fixed at the moved position by means of the moving and fixing mechanism, which never moves in the opposite direction, so that the movement of the spiral shafts in the axial direction is surely precluded, thereby enabling the fixing of the inclination of the stand plate to be performed tightly.

What is claimed is:

1. An apparatus for fixing an inclined position of a stand plate and the like comprising:

a stand frame in which a movable plate is interposed and inserted in a gap formed by spacers intervening between an upper plate and a lower plate; a stand plate having a center supported in free tilting movement on an upper end of a main column provided in a standing state on said stand frame, a plurality of spiral shafts hanged in conical rotating movement free at a lower portion of its back face; and a moving and fixing mechanism for the movable plate pivotally supported rotatably to one side of said stand frame, said movable plate engaged and supported in reciprocal movement free and in fixing free;

each of said spiral shafts inserted into insertion holes formed by penetrating through the upper and lower plates of said stand frame and the movable plate in free axially sliding movement so that the spiral thread grooves are fastened at their outer circumferences by cutting into inner faces of the insertion holes accompanying by the movement of the movable plate.

* * * * *